US009020378B2

(12) United States Patent
Fukumuro

(10) Patent No.: US 9,020,378 B2
(45) Date of Patent: Apr. 28, 2015

(54) ELECTROPHOTOGRAPHIC IMAGE FORMING APPARATUS AND METHOD WITH ADJUSTMENT OF IMAGE FORMING CONDITIONS BASED ON CORRECTED REFLECTED LIGHT AMOUNTS

(75) Inventor: Tadashi Fukumuro, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 13/595,233

(22) Filed: Aug. 27, 2012

(65) Prior Publication Data

US 2013/0051827 A1 Feb. 28, 2013

(30) Foreign Application Priority Data

Aug. 31, 2011 (JP) ..... 2011-189322
Aug. 6, 2012 (JP) ..... 2012-174368

(51) Int. Cl.
*G03G 15/00* (2006.01)

(52) U.S. Cl.
CPC ..... *G03G 15/5058* (2013.01)

(58) Field of Classification Search
CPC ..... G03G 15/5058; G03G 15/5041
USPC ..... 399/49, 53, 72, 74
See application file for complete search history.

(56) References Cited

U.S. PATENT DOCUMENTS

2011/0002704 A1* 1/2011 Fujita ..... 399/74

FOREIGN PATENT DOCUMENTS

JP 2005-148299 A 6/2005
JP 2006-150627 A 6/2006
JP 2007-292855 A 11/2007

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

Patch background data at each position of a background where a toner patch is formed in the second rotation is estimated from background measurement data at a plurality of positions detected in the first rotation and patch neighborhood measurement data detected in the second rotation at a plurality of positions where no toner patch is formed. Since the apparatus can execute density measurement before the light emission amount of a density sensor stabilizes, the time required for density measurement can be shorter than before. Since the change ratio of the light emission amount and the variation of the reflected light amount from the background are reflected on the patch background data, the density measurement accuracy can be improved.

19 Claims, 12 Drawing Sheets

ELECTROPHOTOGRAPHIC IMAGE FORMING APPARATUS AND METHOD WITH ADJUSTMENT OF IMAGE FORMING CONDITIONS BASED ON CORRECTED REFLECTED LIGHT AMOUNTS

BACKGROUND OF THE INVENTION

1. Field of the Invention

The present invention relates to an image forming apparatus such as a copying machine, a printer, or a facsimile apparatus which performs image formation by an electrophotographic method.

2. Description of the Related Art

The image density of an image forming apparatus using an electrophotographic method varies depending on the temperature and humidity condition of the ambient circumstances or the frequency in use of the process station. Hence, the image forming apparatus corrects the variation by controlling the image density. The image forming apparatus forms density patches of the respective colors on a photosensitive drum, an intermediate transfer member (to be referred to as an "ITB" hereinafter), or an electrostatic adsorptive transfer belt (to be referred to as an "ETB" hereinafter). The density patches are read by a density detection sensor and fed back to the process forming conditions. This allows the maximum density and the halftone characteristic of each color to be maintained in the ideal state.

In general, the density detection sensor causes a light source to illuminate a density patch and a light-receiving sensor to detect the reflected light intensity. The signal of the reflected light intensity is A/D-converted, processed by the CPU, and fed back to the process forming conditions.

The methods of density detection sensors are roughly classified into a method of detecting the irregularly reflected components of reflected light and a method of detecting the regularly reflected components of reflected light. The irregularly reflected light detection method is suitable to detect a chromatic color toner but unsuitable to detect a black toner because it detects a reflected component perceivable as a color. On the other hand, the regularly reflected light detection method is more advantageous than the irregularly reflected light detection method because it mainly detects reflected light from the background, and density detection can be done independently of the color of toner/background.

In the density sensor using the regularly reflected light detection method of mainly detecting reflected light from the background, if the surface state of the background varies depending on the frequency in use of the background, the reflected light amount varies, too. Japanese Patent Laid-Open No. 2007-292855 describes that normalizing the reflected light amount of a density patch by the reflected light amount of background (to be referred to as "background correction" hereinafter) is effective. Measurement of the background reflected light amount for background correction is performed at the same timing as density patch creation and at the same position of the background as much as possible in consideration of the material unevenness and time-rate change of the ETB or ITB.

The amount of light emitted by the light-emitting element of the density sensor varies due to the influence of heat generation of the light-emitting element itself and the like. The light emission amount largely varies immediately after the start of energization and then moderately converges along with the lapse of time.

Hence, when the sensor performs detection before convergence of the light emission amount, the detection result contains errors. Read by the density sensor may be started after the light emission amount of the light-emitting element has stabilized. In this method, however, the time required for density measurement is long.

SUMMARY OF THE INVENTION

The feature of the present invention is to provide an image forming apparatus capable of improving the measurement accuracy while shortening the measurement time of a sensor.

The present invention provides an image forming apparatus comprising the following elements. An image forming unit forms a toner image on an image carrier. A detection unit detects first reflected light from a background of the image carrier in a state in which the toner image is not formed on the image carrier, second reflected light from the toner image formed on the background of the image carrier in a state in which the toner image is formed on the image carrier, and third reflected light from the background around the toner image where no toner image is formed. A background reflected light amount estimation unit estimates a reflected light amount at each position of the background where the toner image is formed from reflected light amounts of the first reflected light at a plurality of positions and reflected light amounts of the third reflected light at a plurality of positions, which are detected by the detection unit. A correction unit corrects a reflected light amount of the second reflected light by a corresponding reflected light amount estimated by the background reflected light amount estimation unit. A control unit adjusts an image forming condition of the image forming unit based on the reflected light amount corrected by the correction unit.

Further features of the present invention will become apparent from the following description of exemplary embodiments (with reference to the attached drawings).

DESCRIPTION OF THE EMBODIMENTS

Preferred embodiments of the present invention will now be described in detail with reference to the accompanying drawings. Note that the constituent elements described in the embodiments are merely examples, and the technical scope of the present invention is not limited to them.

<Sectional View of Image Forming Apparatus>

Figure 2:
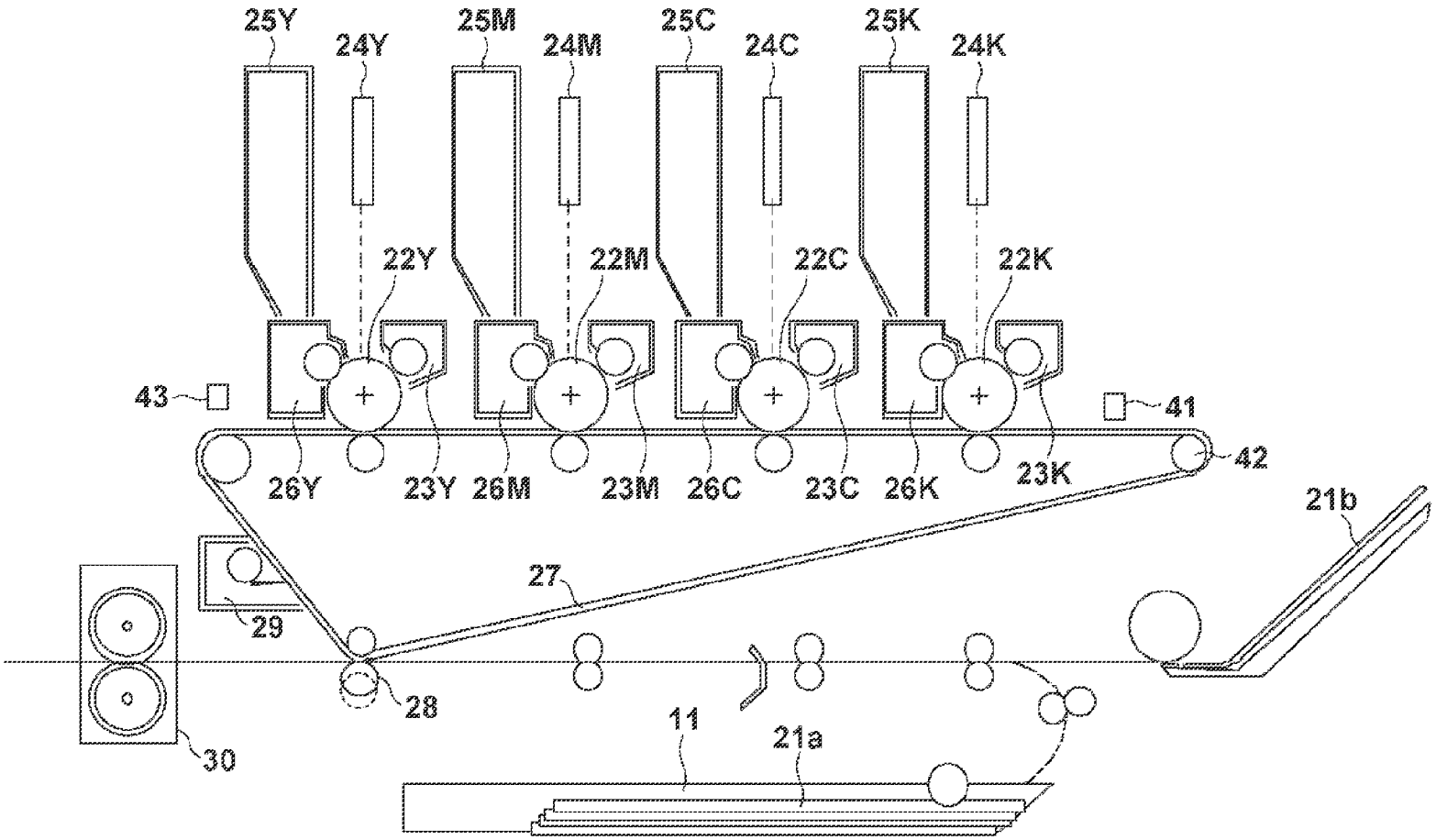
FIG. 2 is a sectional view of an image forming apparatus.

FIG. 2 is a sectional view showing a color image forming apparatus according to an embodiment. An image forming apparatus 100 for forming a multicolor image will be described. The present invention is also applicable to an image forming apparatus for forming a single-color image because of its characteristic. The image forming apparatus 100 forms an electrostatic latent image by exposure light turned on based on image information, and develops the electrostatic latent image to form a single-color toner image. The image forming apparatus 100 superimposes the formed single-color toner images of the respective colors, transfers them to a transfer material 11, and fixes the multicolor toner image on the transfer material 11. The transfer material is also called a printing material, a printing medium, paper, a sheet, or transfer paper. A detailed description will be made below.

The transfer material 11 is fed from a feed unit 21*a* or 21*b*. A photosensitive drum 22 is a kind of image carrier, and rotates upon receiving a driving force transferred from a driving motor (not shown). Y, M, C, and K represent yellow, magenta, cyan, and black, respectively. When explaining an item common to Y, M, C, and K, Y, M, C, and K are omitted from the reference numeral. A charge injector 23 charges the photosensitive drum 22. An optical unit 24 emits exposure light corresponding to image information, thereby selectively exposing the surface of the photosensitive drum 22. An electrostatic latent image is thus formed. A developing unit 26 develops the electrostatic latent image by a printing material (toner) supplied from a toner cartridge 25. Note that the photosensitive drum 22, the charge injector 23, the developing unit 26, and the optical unit 24 form a station which is provided for each of Y, M, C, and K.

An intermediate transfer member 27 is a rotation member which is in contact with the photosensitive drums 22Y, 22M, 22C, and 22K and is rotated clockwise by an intermediate transfer member driving roller 42 so that single-color toner images are transferred to it at the time of color image formation. After that, a transfer roller 28 comes into contact with the intermediate transfer member 27 to sandwich and convey the transfer material 11. The multicolor toner image on the intermediate transfer member 27 is secondarily transferred to the transfer material 11. The transfer roller 28 is in contact with the transfer material 11 during transfer of the multicolor toner image to the transfer material 11, and moves to the position of the broken line after print processing. A fixing device 30 fuses and fixes the multicolor toner image while conveying the transfer material 11. After fixing the toner image, the transfer material 11 is discharged to a discharge tray (not shown) by a discharge roller (not shown), thus ending the image forming operation. A cleaning device 29 cleans the toner remaining on the intermediate transfer member 27. A density sensor 41 is arranged toward the intermediate transfer member 27 in the image forming apparatus 100 to measure the density of a toner patch formed on the surface of the intermediate transfer member 27.

A direction (for example, the conveyance direction of the transfer material 11 or the rotation direction of the intermediate transfer member 27) perpendicular to the main scanning direction of an image when viewed from the upper side will be referred to as a conveyance direction or sub-scanning direction hereinafter.

<Explanation of Density Sensor>

Figure 3:
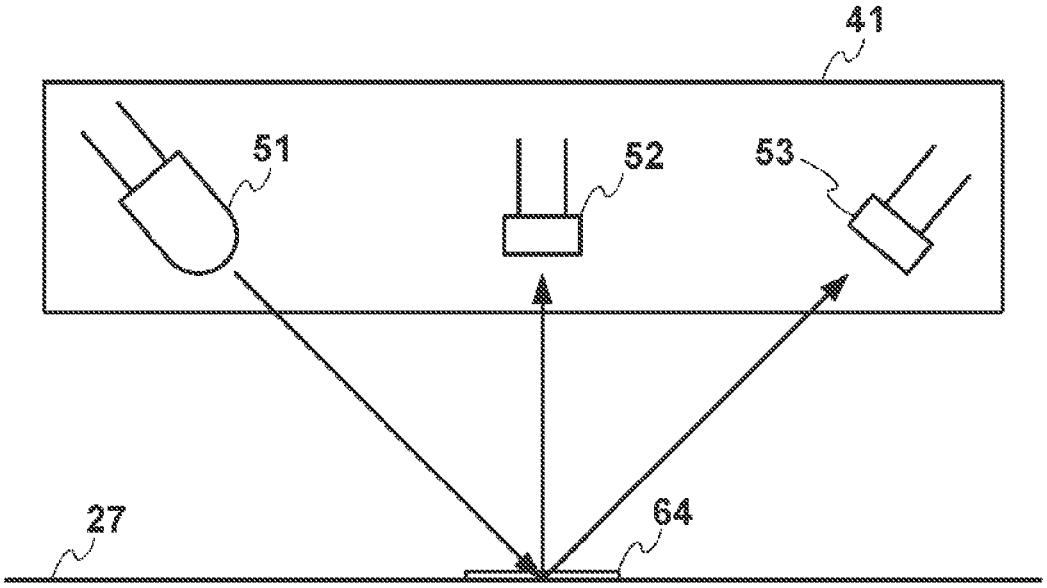
FIG. 3 is a view showing the arrangement of a density sensor.

FIG. 3 shows an example of the arrangement of the density sensor 41. The density sensor 41 includes a light-emitting element 51 such as an LED for emitting infrared light, light-receiving elements 52 and 53 such as a photodiode or a Cds, an IC for processing received light data, and a holder for accommodating these elements. The light-receiving element 52 receives irregularly reflected light from a toner patch 64 and detects the intensity of the light. The light-receiving element 53 receives regularly reflected light and irregularly reflected light from the toner patch 64 or the background and detects their intensities. Detecting both the regularly reflected light intensity and the irregularly reflected light intensity makes it possible to detect the density of the toner patch 64 from a higher density to a lower density. Note that an optical element (not shown) may be used to connect the light-emitting element 51 and the light-receiving element 52.

<Schematic Block Diagram of Image Forming Apparatus>

Figure 4:
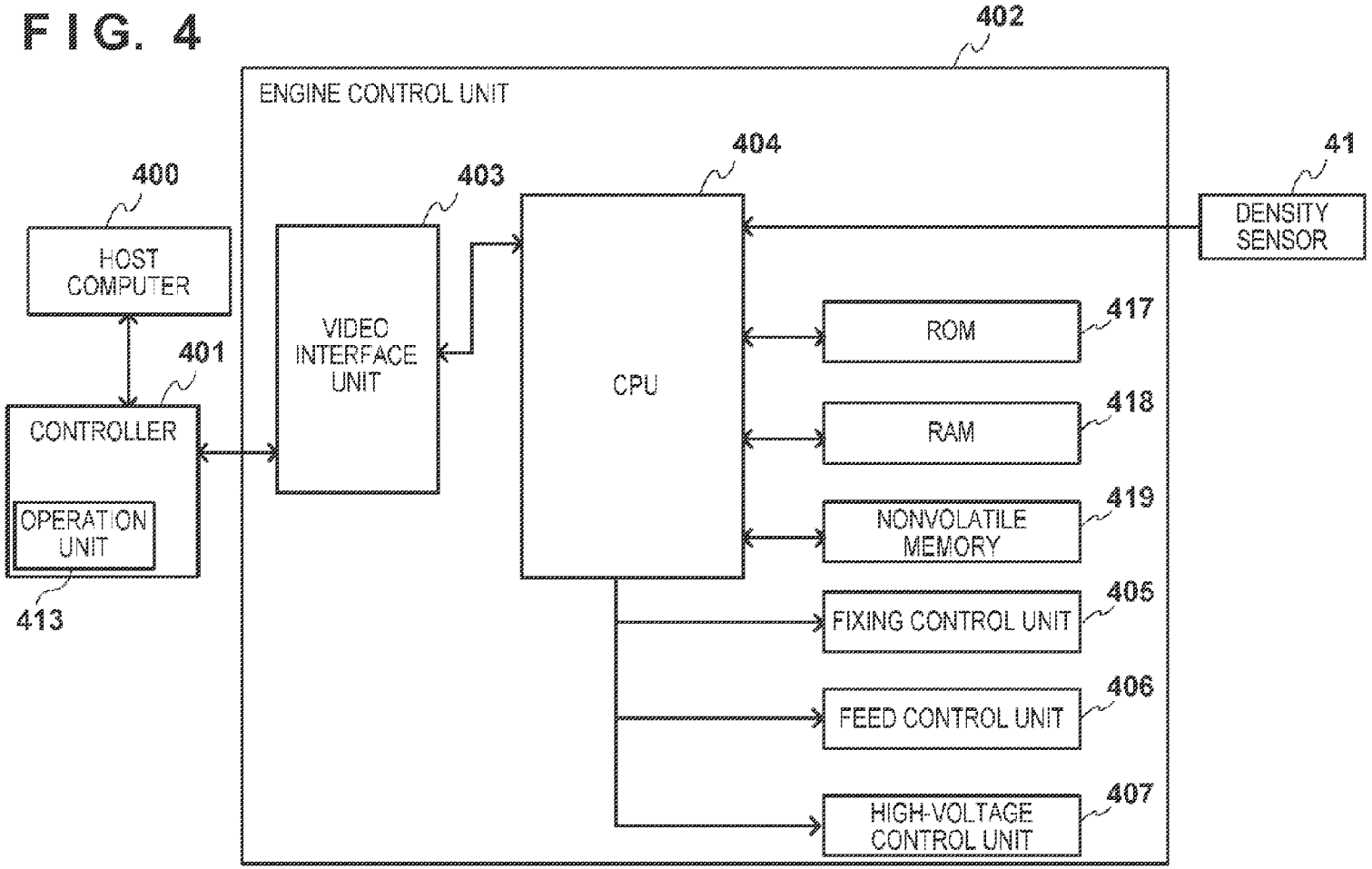
FIG. 4 is a block diagram showing the schematic arrangement of the image forming apparatus.

FIG. 4 is a block diagram for explaining the system arrangement of the image forming apparatus.

A controller 401 can communicate with a host computer 400 or an engine control unit 402. The controller 401 receives image data and print conditions (the number of sheets, the sheet size, and the like) from the host computer 400. The controller 401 rasterizes the image data received from the host computer 400 to generate a video signal (image information) and transmits it to the engine control unit 402 via a video interface unit 403. The controller 401 includes an operation unit 413. The operation unit 413 includes an input unit that receives input of an operation instruction from the user, and a display unit that displays information of the image forming apparatus 100. The video interface unit 403 receives a command or signal transmitted from the controller 401 to the engine control unit 402, and transmits, for example, a signal to request image information or the state of the image forming apparatus from the engine control unit 402 to the controller 401. The video interface unit 403 also receives image information or print information for each transfer material transmitted from the controller 401 to the engine control unit 402.

The engine control unit 402 includes a CPU 404, a ROM 417, a RAM 418, and a nonvolatile memory 419. The control units and various kinds of sensors are connected to the CPU 404. The CPU 404 controls each unit in accordance with programs stored in the ROM 417. The RAM 418 functions as a work area upon executing a program. The nonvolatile memory 419 stores data such as the cumulative number of image formation necessary for control of the image forming apparatus 100. A fixing control unit 405 performs temperature adjustment of the fixing device 30, and the like. A feed control unit 406 controls feed and conveyance of the transfer material 11. A high-voltage control unit 407 controls the charge voltage of the charge injector 23, the primary transfer voltage, and the secondary transfer voltage. These control units operate in accordance with commands from the CPU 404.

Upon receiving a print start command, the CPU 404 outputs, to the controller 401, a /TOP signal serving as the reference timing of video signal output to the first station that is in charge of yellow. The CPU 404 causes the feed control unit 406 to start a feed operation. The feed control unit 406 temporarily puts the fed transfer material 11 on standby at the registration rollers. In synchronism with the arrival of a toner image formed on the intermediate transfer member 27 at the secondary transfer position, the feed control unit 406 resumes feeding the transfer material 11 from the registration rollers. An image generated based on the video signal sent from the controller 401 is transferred to the transfer material 11. The fixing device 30 controlled by the fixing control unit 405 fixes the image on the transfer material 11.

Note that to grasp which position on the peripheral surface of the intermediate transfer member 27 is being detected by the density sensor 41, the CPU 404 detects a marker provided on the peripheral surface of the intermediate transfer member 27. The marker can be detected optically, magnetically, or electrically. The CPU 404 causes a marker sensor 43 for detecting a marker to specify an absolute position on the peripheral surface. For example, if a marker is provided at one portion of the peripheral surface, the marker sensor 43 outputs one detection signal every time the intermediate transfer member 27 makes one rotation. Hence, when the counter starts based on the reference signal, the count value of the counter indicates an absolute position of the peripheral surface. The counter can be either implemented by the CPU 404 as software or implemented by a hardware circuit.

<Density Measurement Toner Patches>

Figure 5:
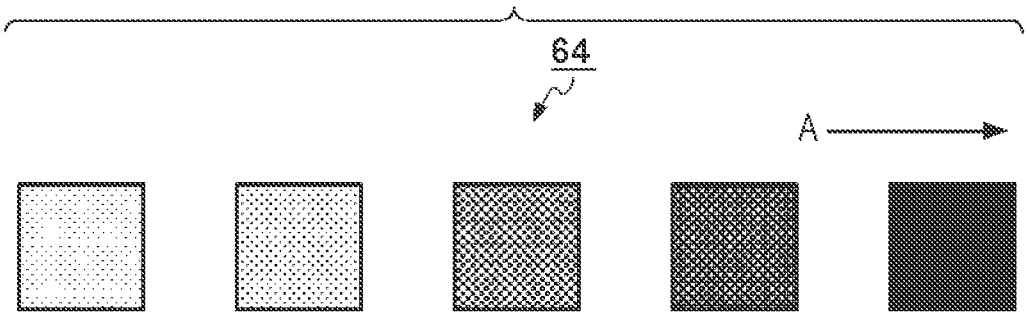
FIG. 5 is a view showing examples of toner patches.

FIG. 5 is a view showing examples of density measurement toner patches. The toner patches 64 include a plurality of toner patches having different densities. Two adjacent toner patches 64 are formed at a predetermined spacing. Since no toner image is formed in this spacing, the density sensor 41 can directly detect the reflected light amount from the background. Note that the number of toner patches 64 is not limited to this example, and changes depending on, for example, the peripheral length of the intermediate transfer member 27 or the time needed for density control.

<Flowchart of Density Control>

Figure 6:
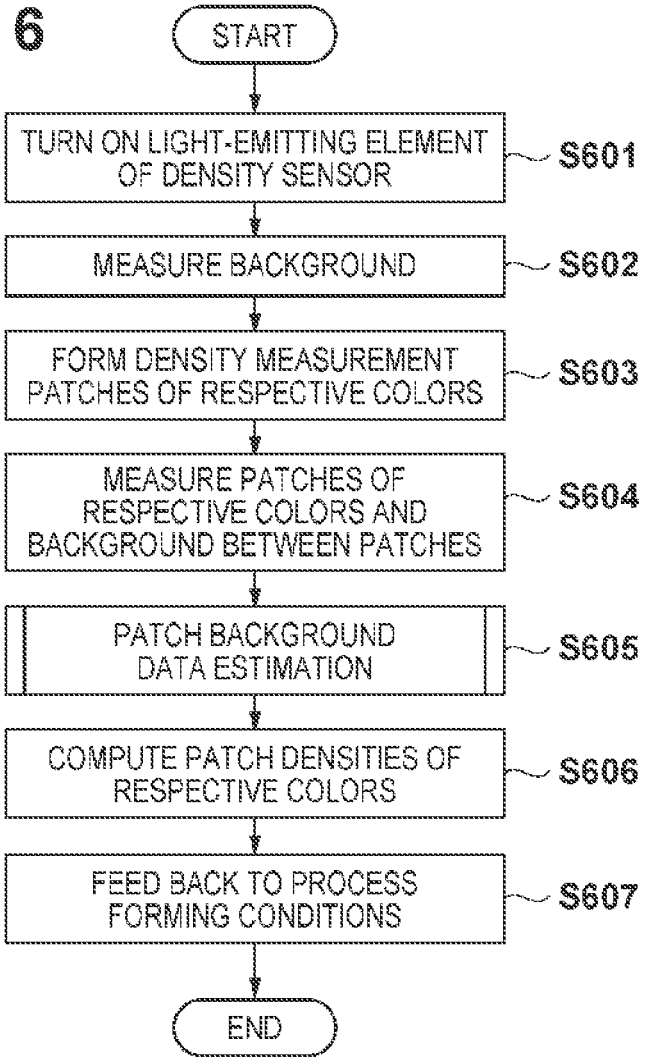
FIG. 6 is a flowchart showing density control.

FIG. 6 is a flowchart of density control which will be described below. Note that processing shown in this flowchart is performed by the CPU 404 in accordance with a control program. The following data will be handled below. Background measurement data is the data of the amount of first reflected light measured from the background. Patch measurement data is the data of the amount of second reflected light measured from a toner patch. Patch neighborhood measurement data is the data of the amount of third reflected light measured from the background near a toner patch. Patch background data is the data of the estimated value of the reflected light amount from the background where a toner patch is formed in the second rotation.

For the sake of simplicity of the present invention, assume that the background is measured in the first rotation, and each patch and its neighborhood are measured in the second rotation. However, each patch and its neighborhood may be measured in the first rotation, and the background may be measured in the second rotation. That is, it is necessary to only execute measurement of the background at a given position and measurement of a patch formed at the position and its neighborhood in different rotations.

In step S601, the CPU 404 turns on the light-emitting element 51 of the density sensor 41.

In step S602, the CPU 404 measures the reflected density of the background of the intermediate transfer member 27 from the reference position on the intermediate transfer member 27 specified by the marker sensor 43. The CPU 404 holds, in the RAM 418 as background measurement data, the reflected density (reflected light amount) of the background measured using the density sensor 41. The measurement of the reflected density of the background is executed in the first rotation of the intermediate transfer member 27. That is, the density sensor 41 functions, in the first rotation of the intermediate transfer member 27, as a detection unit that detects the reflected light from the background of the peripheral surface of the intermediate transfer member 27.

In step S603, the CPU 404 controls the stations to form the density measurement toner patches 64 of the respective colors at predetermined positions on the intermediate transfer member 27. The CPU 404 starts light emission of the optical unit 24 at a timing based on the reference position specified by the marker sensor 43, thereby forming the toner patches 64 at the predetermined positions on the intermediate transfer member 27. The CPU 404 inputs image information corresponding to the toner patches 64 to the optical unit 24.

In step S604, the CPU 404 measures the reflected densities of the toner patches 64 and stores them in the RAM 418 as patch measurement data. The CPU 404 also measures the reflected densities of the background of the intermediate transfer member 27 near the toner patches 64 and holds them in the RAM 418 as patch neighborhood measurement data. Acquisition of the patch measurement data and the patch neighborhood measurement data is executed in the second rotation of the intermediate transfer member 27. That is, the density sensor 41 functions, in the second rotation of the intermediate transfer member 27, as a detection unit that detects the reflected light from each toner patch 64 formed on the background and the reflected light from the background around each toner patch 64 where no toner patch 64 is formed.

In step S605, the CPU 404 estimates patch background data in the second rotation from the background measurement data at each patch formation position acquired in the first rotation and the patch neighborhood measurement data acquired in the second rotation in order to correct the variation component of the light emission amount of the density sensor 41. In the second rotation, since the toner patches 64 are formed, the background measurement data at those positions cannot directly be acquired. Hence, the CPU 404 estimates the patch background data in the second rotation from the background measurement data at each position acquired in the first rotation and the patch neighborhood measurement data near the position.

In step S606, the CPU 404 computes the patch densities from the patch background data (estimated values) and the patch measurement data (measured values). The computation method is known, and a detailed description thereof will be omitted. That is, the CPU 404 functions as a density value computation unit that computes a density value by correcting the reflected light amount detected in the second rotation from each toner image by the corresponding estimated reflected light amount. The density value indicates a corrected reflected light amount that can be converted into a patch density or is correlated with a patch density. As a detailed density value computation method, for example, $$\text{density value (corrected reflected light amount)} = Pr/Br - \alpha \times Pd \qquad \text{Eq. 0}$$

is usable. The computation method is not limited to this equation, as a matter of course, and various known density value computation methods are applicable.

Note that the variables and constants used in equation 0 are as follows.

Pr: the detection result by the light-receiving element 53 out of the patch measurement data Br: the detection result by the light-receiving element 53 out of the patch background measurement data α: coefficient Pd: the detection result by the light-receiving element 52 out of the patch measurement data In step S607, the CPU 404 feeds back the computed patch densities (corrected reflected light amounts) to image forming conditions. The CPU 404 changes the image forming conditions (lookup table) or changes the charge voltage of the charge injector 23 or the transfer bias so as to adjust and control the image forming conditions so that each patch density becomes closer to the target density. That is, the CPU 404 functions as a feedback unit that feeds back the computed density values to the image forming conditions concerning the toner image densities and a control unit that adjusts the image forming conditions.

<Background Data Estimation Processing>

Figure 1A:
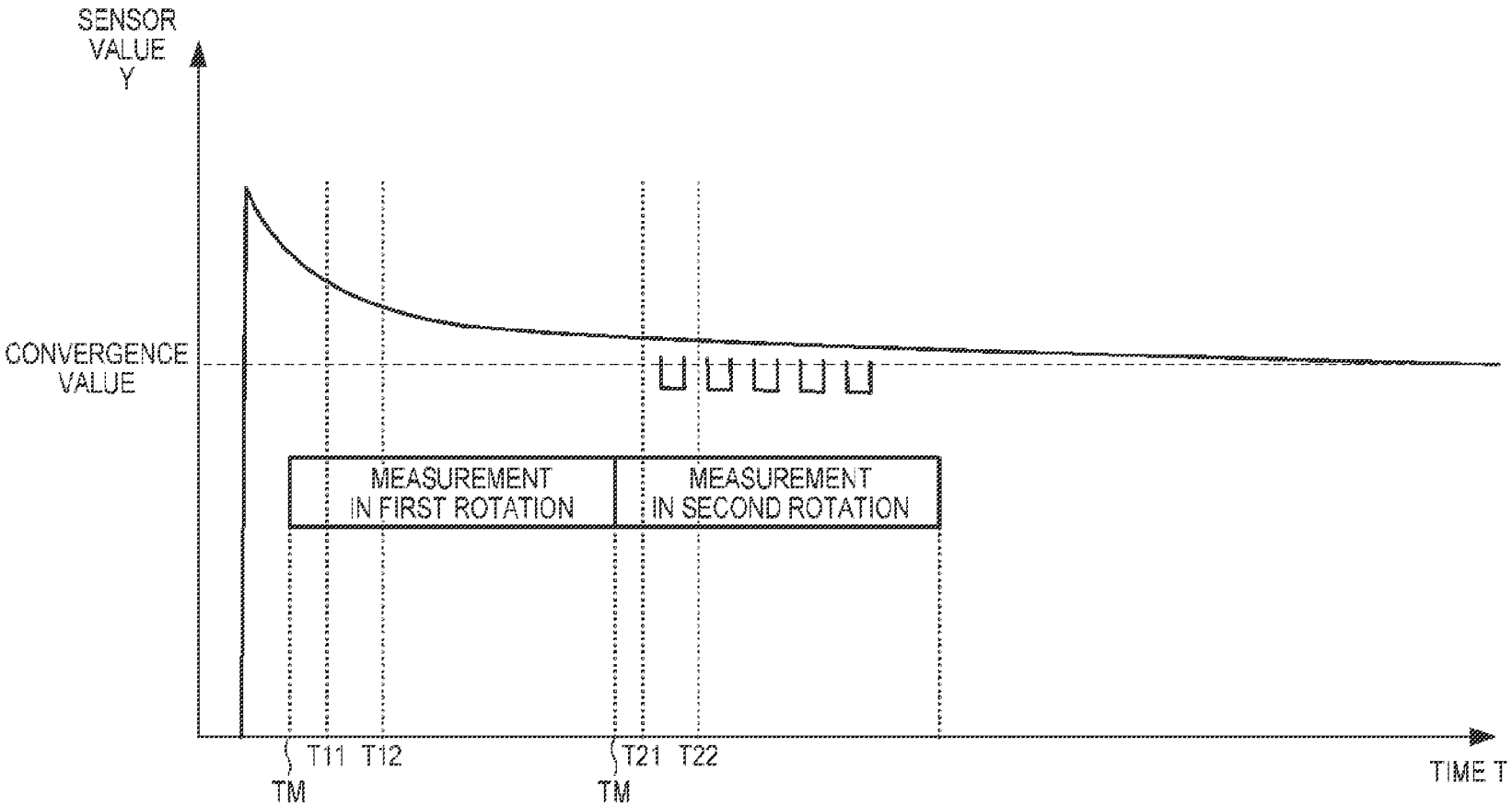
FIGS. 1A and 1B are timing charts for explaining background data correction processing.
Figure 1B:
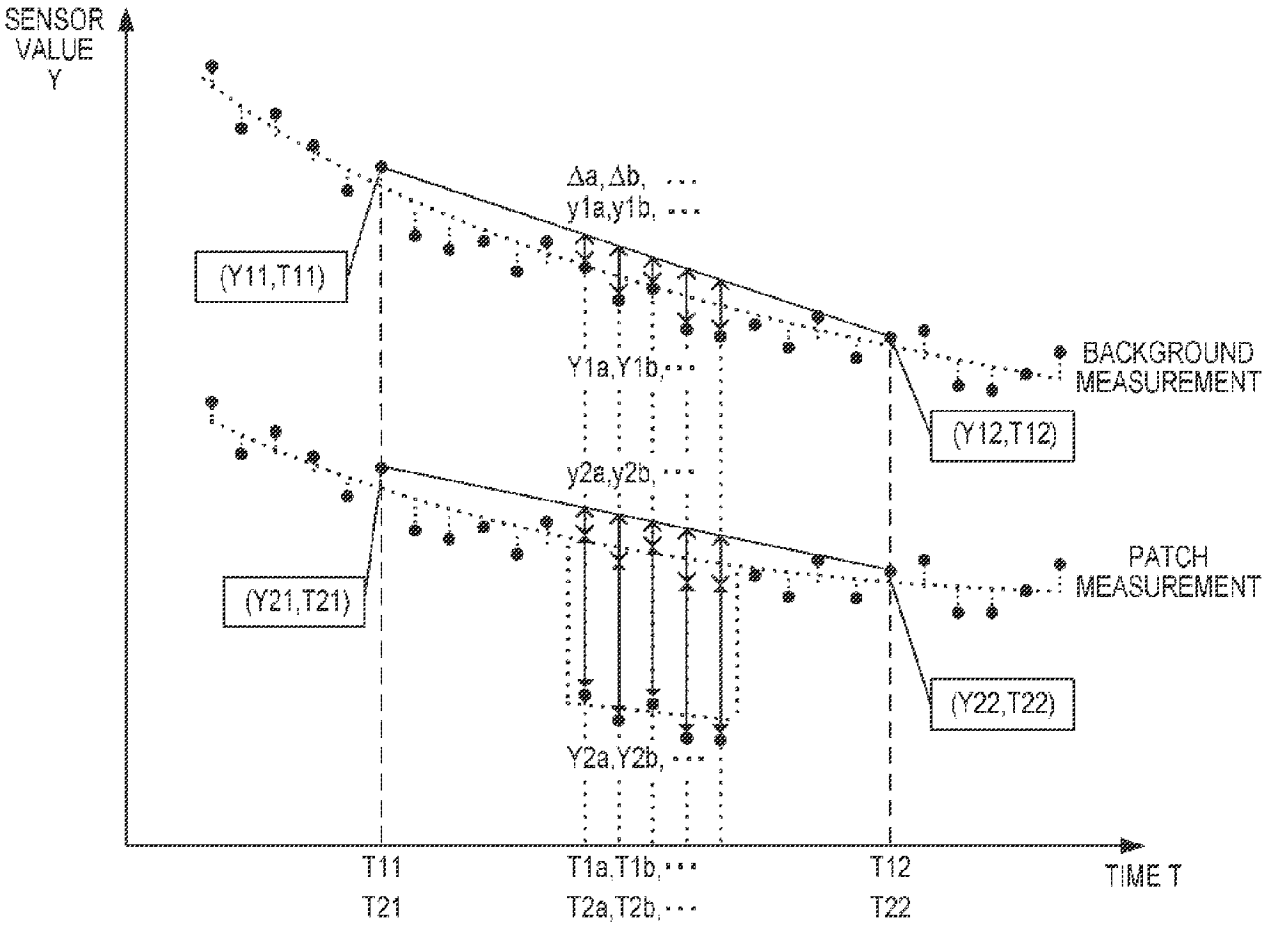

FIGS. 1A and 1B show the outline of background data estimation processing. FIG. 1A shows the outline of the times of background measurement in the first rotation and patch measurement in the second rotation and the value of the density sensor 41. TM is the timing the marker sensor 43 has detected a marker. T11 and T12 are the measurement timings in the first rotation. T21 and T22 are the measurement timings in the second rotation. Note that since T11, T12, T21, and T22 are timings based on TM, T11, T12, T21, and T22 correspond to the same positions on the peripheral surface of the intermediate transfer member 27. That is, data acquired at T11 and data acquired at T21 are data acquired at the same positions on the peripheral surface. That is, Tij is information representing a position j in the ith rotation. As a characteristic of the density sensor 41, the light emission amount of the light-emitting element 51 changes from the start of light emission along with the lapse of time. In this embodiment, to shorten the measurement time in density control, the measurement starts immediately after the start of light emission. For this reason, the light emission amount of the light-emitting element 51 changes even during measurement along with the lapse of time.

The light emission amount that changes along with the lapse of time changes between the background measurement in the first rotation and the patch measurement in the second rotation. For this reason, even when a position on the intermediate transfer member 27 at which no patch is formed is measured, the measured value of the density sensor 41 changes between the first rotation and the second rotation. The difference in the light emission amount between the measurement in the first rotation and that in the second rotation leads to an error in the background data of the toner patch 64. In this embodiment, patch background data in the second rotation is estimated from the background measurement data acquired in the first rotation and the patch neighborhood measurement data from the background near the toner patch 64. This allows to reduce the influence of the difference in the light emission amount of the light-emitting element 51 between the first rotation and the second rotation on the patch density computation.

Figure 7:
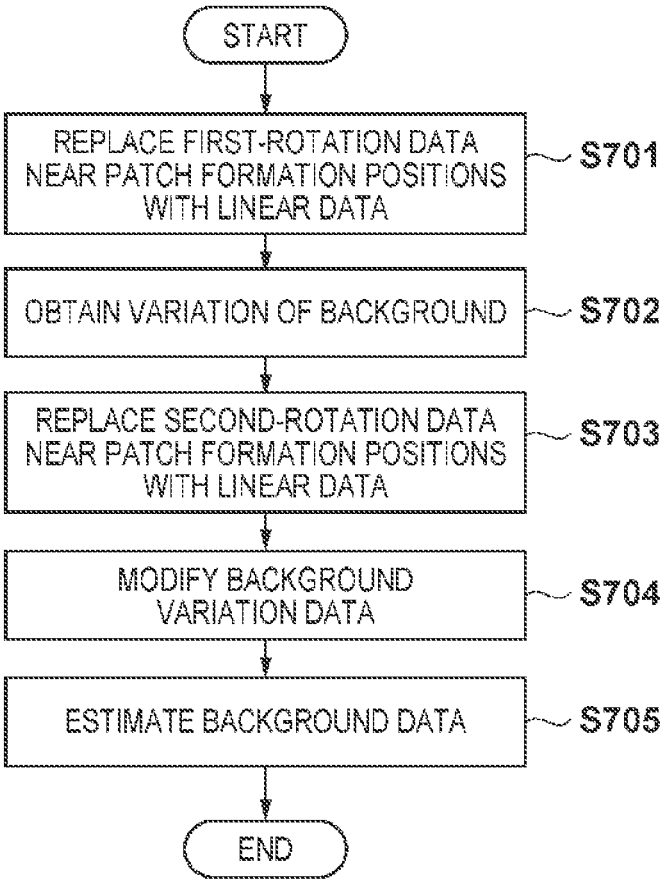
FIG. 7 is a flowchart showing patch background data estimation processing.

FIG. 1B is a timing chart in which T11, T12, T21, and T22 that are the measurement timings at the same positions on the intermediate transfer member 27 in FIG. 1A are plotted at the same positions on the time axis. FIG. 7 is a flowchart of patch background data estimation and patch measurement data correction processing. Note that steps S701 to S705 correspond to step S605 of FIG. 6. Processing of correcting the change in the light emission amount that changes along with the lapse of time during measurement will be described below with reference to FIGS. 1B and 7.

In step S701, the CPU 404 replaces data near the patch formation positions out of the background measurement data in the first rotation with linear data. More specifically, the CPU 404 obtains a gradient α and an intercept m, which satisfy $$y1=\alpha\times T1+m \qquad \text{Eq. 1}$$

from a measured value Y11 at the time T11 and a measured value Y12 at the time T12. Equation 1 is a first equation that expresses the relationship between the position and the reflected light amount derived from the reflected light amounts Y11 and Y12 detected at the plurality of positions T11 and T12 in the first rotation of the intermediate transfer member 27. That is, the CPU 404 functions as a first derivation unit that derives the first equation.

In step S702, the CPU 404 obtains the variation of the background from equation 1. First, the CPU 404 substitutes times T1*a*, T1*b*, and T1*c* corresponding to the patch formation positions into equation 1 to obtain values y1*a*, y1*b*, and y1*c*. Note that a notation such as "y1*a*" using a lower-case y means a logic value obtained by computation of equation 1. The CPU 404 computes a variation value Δ generated by the material unevenness or the time-rate change of the background from the values y1*a*, y1*b*, and y1*c* and actual measured values Y1*a*, Y1*b*, and Y1*c*. This computation is done using $$\Delta=y-Y \qquad \text{Eq. 2}$$

Values Δa, Δb, and Δc are obtained by equation 2. The CPU 404 thus computes, from the first equation, the reflected light amounts y1*a*, y1*b*, and y1*c* at the plurality of positions T1*a*, T1*b*, and T1*c* of the background. The CPU 404 also functions as a variation value computation unit that computes the differences between the reflected light amounts y1*a*, y1*b*, and y1*c* and the reflected light amounts Y1*a*, Y1*b*, and Y1*c* detected at the plurality of positions in the first rotation of the intermediate transfer member 27 as the variation values Δa, Δb, and Δc.

In step S703, the CPU 404 replaces data near the patch formation positions out of the background measurement data measured at the patch non-formation position in the second rotation with linear data. More specifically, the CPU 404 obtains a gradient β and an intercept n, which satisfy $$y2=\beta\times T2+n \qquad \text{Eq. 3}$$

from a measured value Y21 at the time T21 and a measured value Y22 at the time T22. That is, the CPU 404 functions as a second derivation unit that derives the second equation 3 representing the relationship between the position and the reflected light amount from the reflected light amounts Y21 and Y22 detected in the second rotation at the plurality of positions T21 and T22 where no toner image is formed.

In step S704, the CPU 404 modifies the variation values of the background. The CPU 404 substitutes times T2*a*, T2*b*, and T2*c* corresponding to the patch formation positions into equation 3 to obtain values y2*a*, y2*b*, and y2*c*.

The CPU 404 also computes the change ratio of the reflected light amount between the first rotation and the second rotation from the reflected light amount computed from equation 1 and that computed from equation 3 for each of the plurality of positions of the background where the toner patches 64 are formed in the second rotation. That is, the CPU 404 functions as a change ratio computation unit. In this case, the change ratios by the light amount difference between background measurement and patch measurement are y2*a*/y1*a*, y2*b*/y1*b*, and y2*c*/y1*c*.

$$\Delta'=\Delta\times(y2/y1) \qquad \text{Eq. 4}$$

The CPU 404 substitutes the change ratios and the variation values Δa, Δb, and Δc into equation 4, thereby obtaining variation values Δa', Δb', and Δc' modified by the change ratios. That is, the CPU 404 functions as a variation value modification unit that modifies the variation values at the plurality of positions of the background in the first rotation by corresponding change ratios, thereby obtaining the variation values at the plurality of positions of the background in the second rotation.

In step S705, the CPU 404 estimates patch background data at the patch formation positions. The CPU 404 corrects the values y2*a*, y2*b*, and y2*c* obtained from equation 3 by the variation values Δa', Δb', and Δc' of the background, thereby estimating patch background data Ba, Bb, and Bc. The estimation formula is $$B=y2-\Delta' \quad \text{Eq. 5}$$

The CPU 404 thus obtains the reflected light amounts from equation 3 for the plurality of positions of the background where the toner patches are formed in the second rotation. In addition, the CPU 404 corrects these reflected light amounts by the modified variation values, thereby estimating the reflected light amounts at the plurality of positions where the toner patches are formed in the second rotation. After that, in step S606 described above, the CPU 404 computes the patch densities from the patch background data Ba, Bb, and Bc and the patch measurement values.

Note that when y1 (y1*a*, y1*b*, . . . ) and Y1 (Y1*a*, Y1*b*, . . . ) are substituted into equation 2, we obtain Δ=y1−Y1. When this is substituted into equation 4, we obtain Δ'=(y1−Y1)×(y2/y1). When this is substituted into equation 5, we obtain $$B=y2-(y1-Y1)\times(y2/y1)$$

$$B=Y1\times(y2/y1) \quad \text{Eq. 6}$$

That is, the same background data B as that of equation 5 can be obtained even by multiplying the surface measured value Y1 of the actual intermediate transfer member 27 by the ratio of the arithmetic logic values at the same/substantially same background positions in the first and second rotations.

As described above, in this embodiment, the reflected light amount at each position of the background where the toner image is formed in the second rotation is estimated from the reflected light amounts detected in the first rotation at the plurality of positions and the reflected light amounts detected in the second rotation at the plurality of positions where no toner image is formed. That is, the CPU 404 functions as a background reflected light amount estimation unit. In this embodiment, since density measurement can be executed before the light emission amount of the density sensor 41 stabilizes, the time required for density measurement can be shorter than before.

The CPU 404 also obtains the change ratio of the reflected light amount between the first rotation and the second rotation of the rotation member from the reflected light amounts detected in the first rotation at the plurality of positions and those detected in the second rotation at the plurality of positions where no toner image is formed. In addition, the CPU 404 modifies the variation value of the reflected light amount at each position of the background in the first rotation by the change ratio, thereby obtaining the reflected light amount at each position of the background in the second rotation. Alternatively, the CPU 404 corrects the reflected light amount at each position of the background in the first rotation using the change ratio. That is, in this embodiment, the reflected light amount at each position of the background where the toner patch 64 is formed is estimated using the change ratio of the light emission amount. This allows to shorten the time required for density measurement and improve the accuracy.

Figure 12:
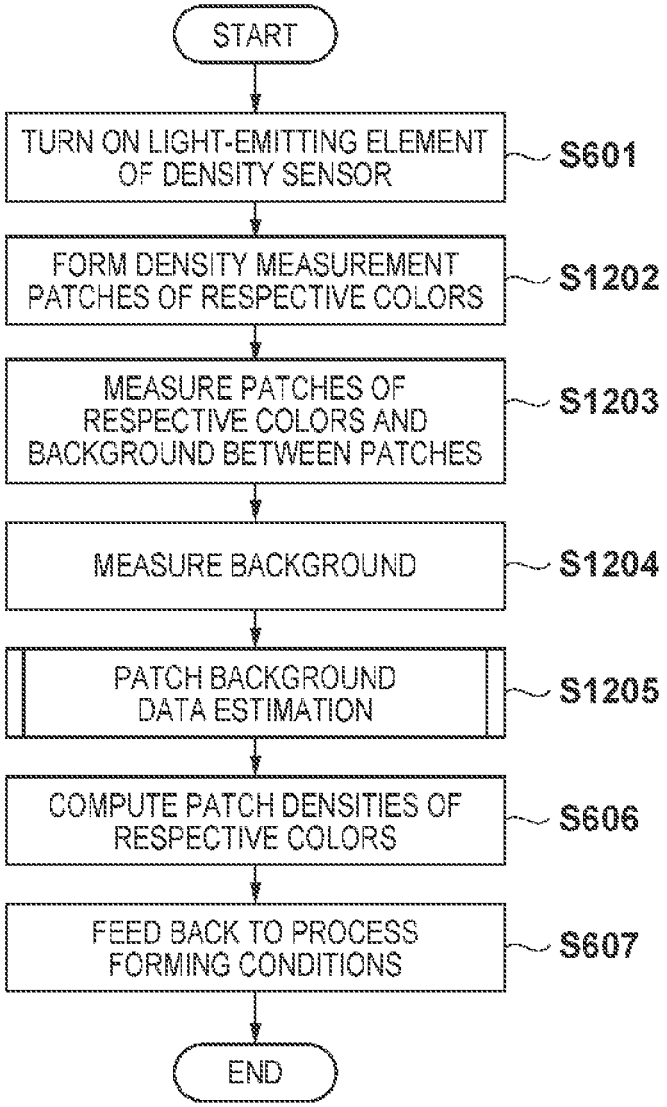
FIG. 12 is a flowchart showing density control.

For the sake of simplicity of the present invention, assume that the background is measured in the first rotation, and each patch and its neighborhood are measured in the second rotation. However, each patch and its neighborhood may be measured in the first rotation, and the background may be measured in the second rotation, as shown in FIG. 12. That is, it is necessary to only execute measurement of the background at a given position and measurement of a patch formed at the position and its neighborhood in different rotations.

Another control method will be described with reference to FIG. 12. Note that steps S601, S606, and S607 are the same as in FIG. 6, and a description thereof will be omitted. The process advances from step S601 to step S1202.

In step S1202, the CPU 404 controls the stations to form the density measurement toner patches 64 of the respective colors at predetermined positions on the intermediate transfer member 27. The CPU 404 starts light emission of the optical unit 24 at a timing based on the reference position specified by the marker sensor 43, thereby forming the toner patches 64 at the predetermined positions on the intermediate transfer member 27. The CPU 404 inputs image information corresponding to the toner patches 64 to the optical unit 24.

In step S1203, the CPU 404 measures the reflected densities of the toner patches 64 and stores them in the RAM 418 as patch measurement data. The CPU 404 also measures the reflected densities of the background of the intermediate transfer member 27 near the toner patches 64 and holds them in the RAM 418 as patch neighborhood measurement data. Acquisition of the patch measurement data and the patch neighborhood measurement data is executed in the first rotation of the intermediate transfer member 27. That is, the density sensor 41 functions, in the first rotation of the intermediate transfer member 27, as a detection unit that detects the reflected light from each toner patch 64 formed on the background and the reflected light from the background around each toner patch 64 where no toner patch 64 is formed.

In step S1204, the CPU 404 measures the reflected density of the background of the intermediate transfer member 27 from the reference position on the intermediate transfer member 27 specified by the marker sensor 43. The CPU 404 holds, in the RAM 418 as background measurement data, the reflected density (reflected light amount) of the background measured using the density sensor 41. The measurement of the reflected density of the background is executed in the second rotation of the intermediate transfer member 27. That is, the density sensor 41 functions, in the second rotation of the intermediate transfer member 27, as a detection unit that detects the reflected light from the background of the peripheral surface of the intermediate transfer member 27.

In step S1205, the CPU 404 estimates patch background data in the first rotation from the background measurement data at each patch formation position acquired in the second rotation and the patch neighborhood measurement data acquired in the first rotation in order to correct the variation component of the light emission amount of the density sensor 41. In the first rotation, since the toner patches 64 are formed, the background measurement data at those positions cannot directly be acquired. Hence, the CPU 404 estimates the patch background data in the first rotation from the background measurement data at each position acquired in the second rotation and the patch neighborhood measurement data near the position. The detailed calculation method has already been described with reference to FIG. 7.

After that, the CPU 404 executes steps S606 and S607.

As described above, either of the step of acquiring the actual background measurement data at the patch formation positions and the step of acquiring the patch neighborhood measurement data can be executed first. In addition, the two steps need not always be executed in continuous rotations. This can be generalized in the following way. The detection unit detects reflected light from the background of the rotation member in the hth rotation of the rotation member, and detects, in the ith rotation of the rotation member, reflected light from a toner image formed on the background of the rotation member and reflected light from the background around the toner image where no toner image is formed. The background reflected light amount estimation unit estimates the reflected light amount at each position of the background where the toner image is formed in the ith rotation of the rotation member from the reflected light amounts detected at the plurality of positions in the hth rotation of the rotation member and the reflected light amounts detected in the ith rotation of the rotation member at the plurality of positions where no toner image is formed (h and i are different natural numbers). The correction unit corrects the reflected light amount from a toner image detected in the ith rotation of the rotation member by a corresponding reflected light amount estimated by the background reflected light amount estimation unit.

As described above, either of h>i and h<i can hold, and |h−i| need not always be 1. However, when |h−i|=1, the estimation accuracy is supposedly high. That is, the patch background data estimation accuracy is supposed to be high when the steps are executed in two continuous rotations. This is because the time difference between the two steps is short.

In the above-described embodiment, the patch background data is estimated based on the background data and the measurement data at the same positions on the intermediate transfer member near the patches. In this embodiment, a method of estimating patch background data from the average value of measurement data at several points will be described. Since the average value is used, the influence of the shift of measurement positions on the intermediate transfer member 27 caused by measurement timing errors can be reduced. The schematic arrangement of the image forming apparatus according to this embodiment and the procedure of density control are the same as in the above-described embodiment, and a description thereof will be omitted.

Figure 8:
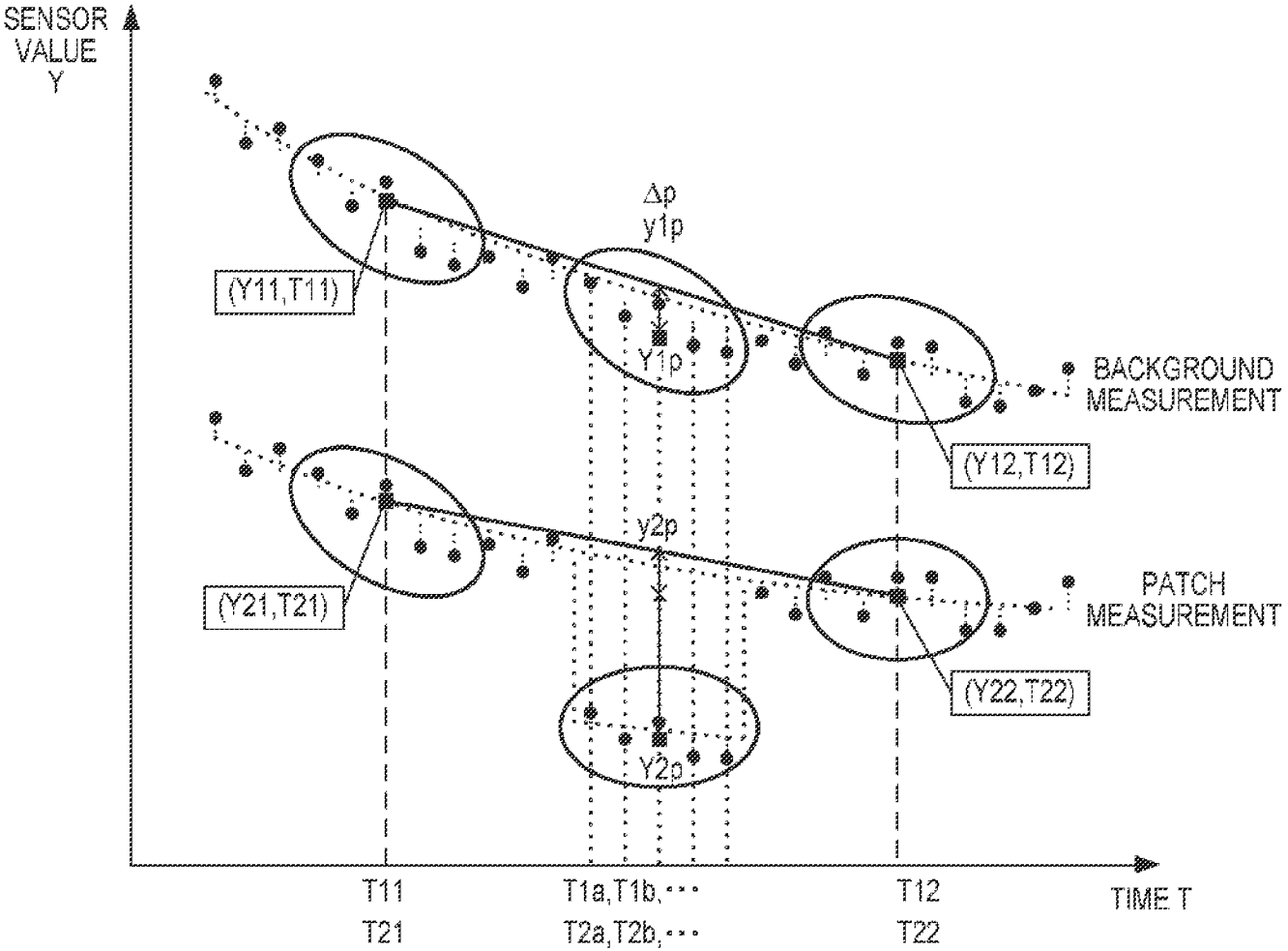
FIG. 8 is a timing chart showing the outline of patch background data estimation processing.
Figure 9:
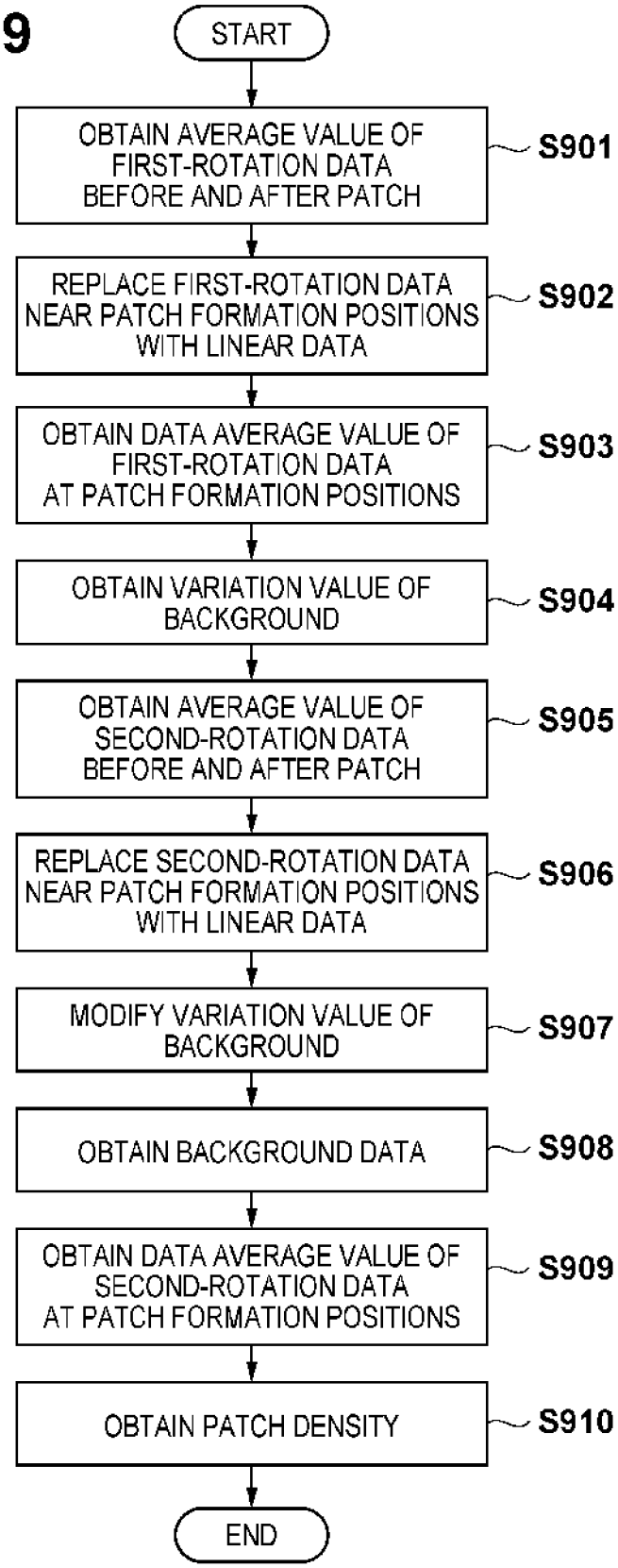
FIG. 9 is a flowchart showing patch background data estimation processing.

FIG. 8 is a timing chart in which T11, T12, T21, and T22 that are the measurement timings at the same positions on the intermediate transfer member are plotted at the same positions on the time axis, as in the above embodiment. FIG. 9 is a flowchart showing patch background data estimation processing according to this embodiment. Background data correction processing according to this embodiment will be described below with reference to FIGS. 8 and 9. Note that steps S901 to S908 correspond to step S605 of FIG. 6, and steps S909 and S910 correspond to step S606 of FIG. 6.

In step S901, the CPU 404 obtains the average value of background measurement data in the first rotation at positions before and after the patch formation positions. As shown in FIG. 8, the CPU 404 obtains the average value Y11 for five points before and after the time T11 and the average value Y12 for five points before and after the time T12. The average value is not limited to a simple average (arithmetic mean), and a weighted average (weighted mean) may be applied.

In step S902, to replace data near the patch formation positions in the first rotation with linear data, the CPU 404 obtains the gradient α and the intercept m which satisfy equation 1 from the times T11 and T12 and the average values Y11 and Y12. That is, the CPU 404 functions as a first derivation unit that obtains the average value of reflected light amounts at a plurality of positions detected in the first rotation of the intermediate transfer member 27 and derives equation 1 from the plurality of average values Y11 and Y12.

In step S903, the CPU 404 obtains an average value Y1*p* of background measurement data in the first rotation at the same positions as the five patch formation positions in the second rotation. Let T1*p* be the time corresponding to the average value Y1*p*. T1*p* is the average of the times at the five points. T1*p* can also be regarded as the midpoint of the time of the five points.

In step S904, to obtain the variation value Δ of the background, the CPU 404 substitutes the time T1*p* into equation 1 derived in step S902 to obtain a value y1*p*. In addition, the CPU 404 substitutes y1*p* and Y1*p* into equation 2 to obtain a variation value Δp of the background.

In step S905, the CPU 404 obtains the average value of patch neighborhood measurement data in the second rotation at positions before and after the patch formation positions. The CPU 404 obtains the average value Y21 for five points before and after the time T21 and the average value Y22 for five points before and after the time T22.

In step S906, to replace patch neighborhood measurement data with linear data, the CPU 404 obtains the gradient β and the intercept n which satisfy equation 3 from the average values Y21 and Y22. That is, the CPU 404 functions as a second derivation unit that obtains the average value of reflected light amounts detected in the second rotation of the intermediate transfer member 27 at a plurality of positions detected where no toner patches 64 are formed and derives equation 3 from the plurality of average values Y21 and Y22.

In step S907, the CPU 404 modifies the variation value of the background. First, the CPU 404 substitutes the time T1*p* into equation 3 obtained in step S906 to obtain a value y2*p*. The CPU 404 also obtains the change ratio from y1*p* and y2*p* and substitutes the change ratio and the variation value Δp into equation 4 to obtain a modified variation value Δp'.

In step S908, the CPU 404 substitutes y2*p* and the modified variation value Δp' into equation 5 to obtain patch background data Bp (=y2*p*−Δp').

In step S909, the CPU 404 obtains an average value Y2*p* of patch measurement data at the five points acquired at the patch formation positions.

In step S910, the CPU 404 obtains the patch density from the average value Y2*p* of the patch measurement data and the patch background data Bp. That is, the CPU 404 functions as a density value computation unit that obtains the average value Y2*p* of the reflected light amounts from the toner patches 64 detected in the second rotation and corrects the average value Y2*p* by the corresponding patch background data Bp, thereby computing the density value. Note that the processing of correcting the average value Y2*p* of the reflected light amounts from the toner patches 64 detected in the second rotation by the patch background data may be executed in step S606 of the above-described embodiment.

As described above, in this embodiment, the patch background data is estimated from the average value of measurement data at several points. This allows to reduce the influence of the shift of measurement positions on the intermediate transfer member 27 caused by measurement timing errors.

Note that in the above-described embodiment, since all of the measurement data in the first rotation and the second rotation are held in the RAM 418 to execute patch density correction processing, a large RAM capacity is necessary. On the other hand, in this embodiment, the RAM capacity can be saved because the RAM 418 holds only the average values.

In this embodiment, five measurement points are used to obtain an average value. However, the number of measurement points is not limited, and may be changed in accordance with the peripheral length of the intermediate transfer member 27, the size of the toner patch 64, the capacity of the RAM, and the like.

Note that the CPU 404 may compute the patch background data Bp by Bp=Y1*p*×(y2*p*/y1*p*) using equations 6 described in the above embodiment. That is, the patch background data after correction may be obtained by multiplying the average value Y1*p* of the background measurement data in the first rotation by the ratio (change ratio y2*p*/y1*p*) of the arithmetic logic values (reflected light amounts) at the same/substantially same positions in the first and second rotations of the intermediate transfer member 27.

As described above, when the measurement positions on the intermediate transfer member shift due to measurement timing errors, patch background correction can be performed based on the average value of measurement data at several points, and the RAM capacity can be saved.

In this embodiment of the present invention, position information is computed from the profile of measurement data, and measurement data at the same position is specified from the profile, thereby estimating patch background data. In this embodiment, the density measurement accuracy can thus be higher than in the above-described embodiment. The schematic arrangement of the image forming apparatus according to this embodiment and the procedure of density control are the same as in the above-described embodiment, and a description thereof will be omitted.

Let j be a variable representing each sample position. Let A(j) be measurement data in the first rotation, and B(j) be measurement data in the second rotation. For example, measurement data at the start of measurement in the first rotation is A(0), and measurement data at the start of measurement in the second rotation is B(0).

Figure 10A:
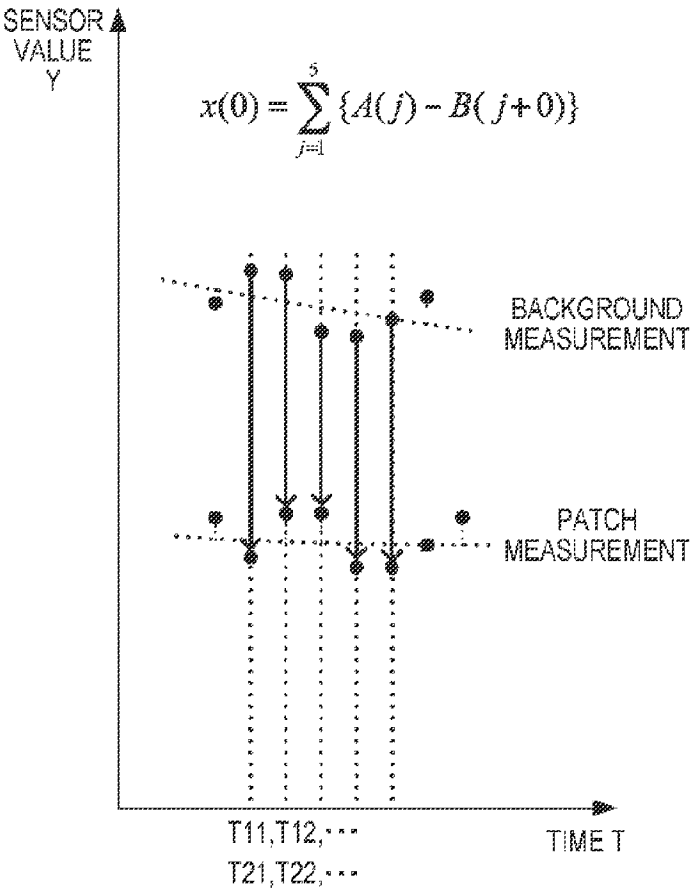
FIGS. 10A and 10B are timing charts for explaining a measurement data profile.
Figure 10B:
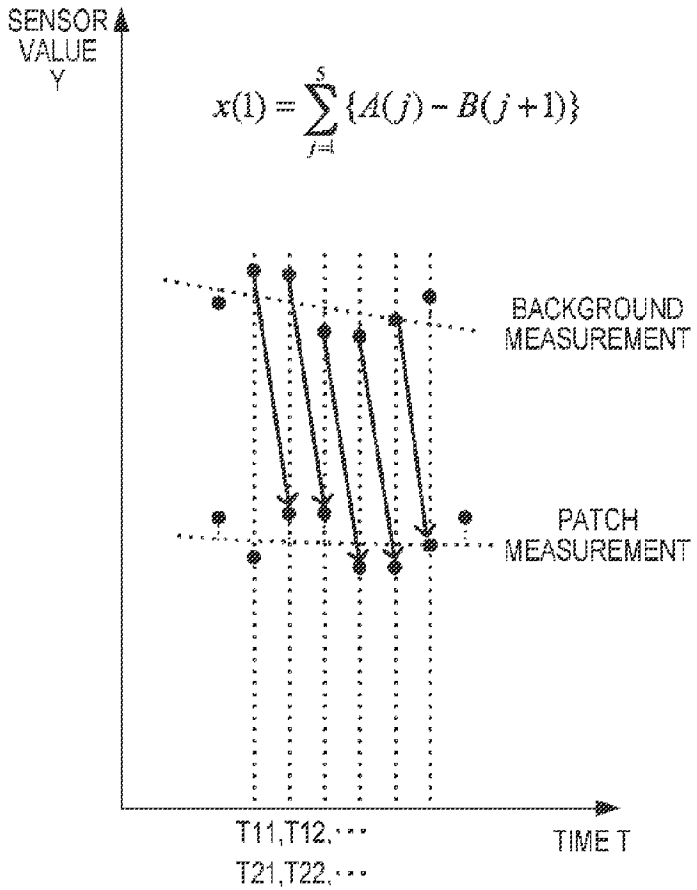

Referring to FIGS. 10A and 10B, T11 and T21 represent the same timing in the first rotation and the second rotation when j=1. They should originally correspond to the same position on the intermediate transfer member 27. Place focus on the measurement data A(j) in the first rotation at a position where no patch is formed and the measurement data B(j) in the second rotation. A(j) is a first profile derived from reflected light amounts detected at a plurality of positions in the first rotation of the intermediate transfer member 27. B(j) is a second profile derived from reflected light amounts detected at the plurality of positions in the second rotation of the intermediate transfer member 27. The CPU 404 functions as a profile derivation unit.

As shown in FIG. 10A, the CPU 404 compares the measurement data A(j) in the first rotation and the measurement data B(j) in the second rotation, which should be measurement data at the same position on the intermediate transfer member 27, with each other, and obtains an integrated value X of the difference by $$x(k) = \sum_{j=1}^{5} \{A(j) - B(j+k)\} \quad \text{Eq. 7}$$

where k is the position shift amount.

FIG. 10B shows an example in which the shift amount k is 1. The CPU 404 obtains the integrated value X 10 times while changing the shift amount k. The shift amount k when the integrated value X is minimum is the modification amount of position data j. For example, A(j) and B(j+k) are measurement data at the same position on the intermediate transfer member 27. The CPU 404 modifies the measurement data B(j) in the second rotation using the shift amount k so as to obtain B(j+k), and executes the method of the above-described embodiment using the modified measurement data B(j+k). That is, the CPU 404 functions as a position data modification unit that specifies a position where a reflected light amount is detected in the second rotation, which corresponds to the position where a reflected light amount is detected in the first rotation by comparing the first profile with the second profile, and modifies data of the position where the reflected light amount is detected in the second rotation.

Figure 11:
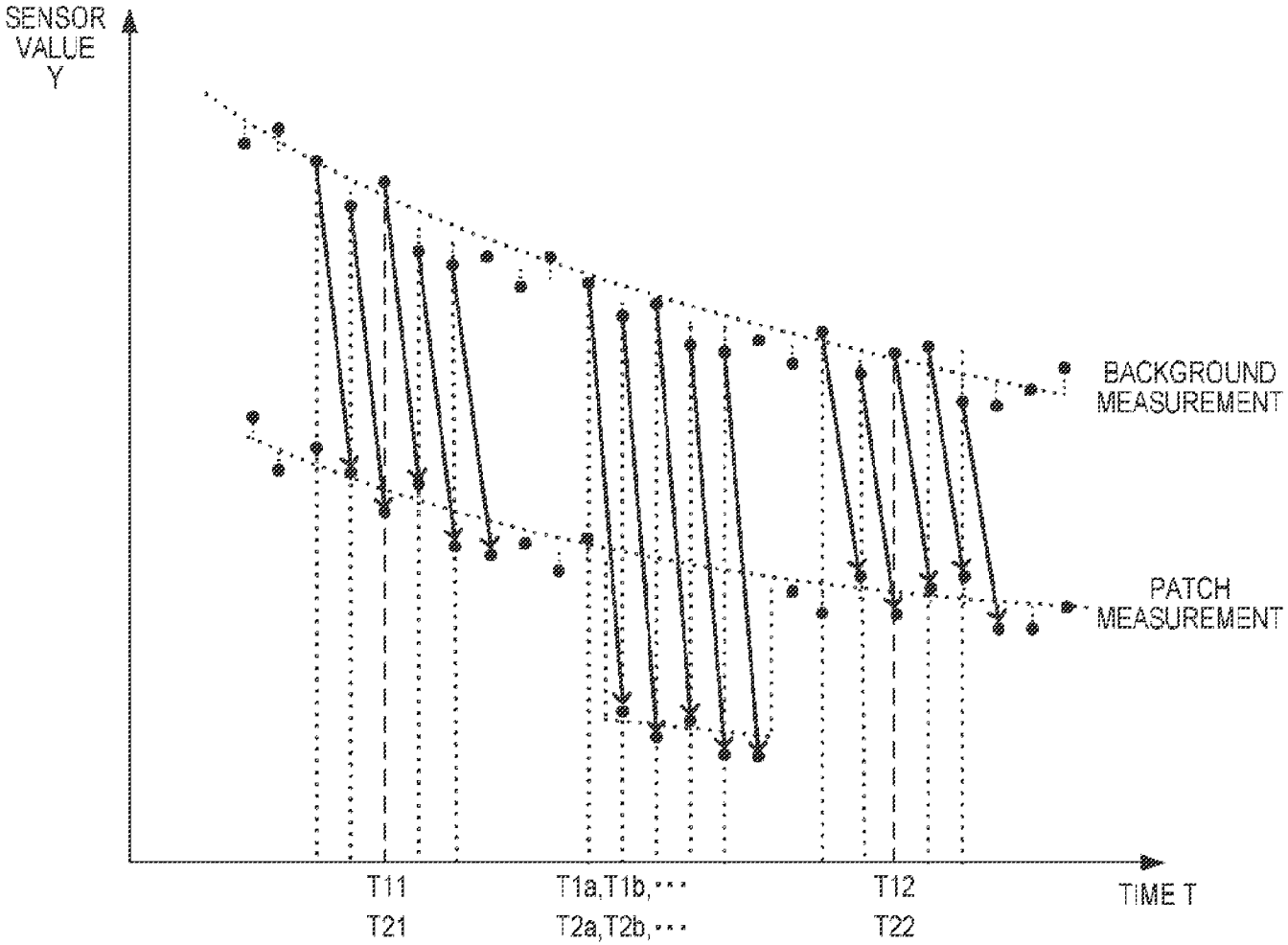
FIG. 11 is a timing chart showing the outline of measurement data position correction.

In the example shown in FIG. 11, the shift amount is set to 1 so that the measurement positions of measurement data in the first rotation match those of measurement data in the second rotation.

As described above, in this embodiment, the CPU 404 specifies measurement data at the same position from the profile of measurement data, thereby estimating patch background data. In this embodiment, the density measurement accuracy can thus be higher than in the above-described embodiment.

Note that in the present invention described above, the toner patches 64 are formed on the intermediate transfer member 27. However, an electrostatic adsorptive transfer belt that adsorbs and conveys the transfer material 11 may be employed in place of the intermediate transfer member 27. This is because in the present invention, even when the electrostatic adsorptive transfer belt is employed as the rotation member, the densities of the toner patches 64 and the density of the background of the electrostatic adsorptive transfer belt can be detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2011-189322 filed Aug. 31, 2011 and 2012-174368 filed Aug. 6, 2012, which are hereby incorporated by reference herein in their entirety.

What is claimed is:

1. An image forming apparatus comprising:

an image forming unit configured to form a toner image on an image carrier;

a detection unit configured to detect, as the image carrier rotates, first reflected light from a background of each one of a plurality of positions of the image carrier in a state in which the toner image is not formed on each one of the plurality of positions of the image carrier in a first rotation, second reflected light from the toner image formed on a first part of each one of the plurality of positions of the image carrier in a state in which the toner image is formed on the first part of each one of the plurality of positions of the image carrier in a second rotation, and third reflected light from the background of a second part of each of the plurality of positions around the toner image where no toner image is formed in the second rotation;

a background reflected light amount estimation unit configured to calculate a change ratio of a reflected light amount between reflected light amounts of the first reflected light at the background of each one of the plurality of positions in the first rotation and reflected light amounts of the third reflected light at the background of the second part of each one of the plurality of positions in the second rotation, which are detected by said detection unit, and to estimate a reflected light amount at the background of the first part of each one of the plurality of positions where the toner image is formed in the second rotation, based on the change ratio;

a correction unit configured to correct a reflected light amount of the second reflected light by a corresponding reflected light amount estimated by said background reflected light amount estimation unit; and a control unit configured to adjust an image forming condition of said image forming unit based on the reflected light amount corrected by said correction unit.

2. The apparatus according to claim 1, wherein said detection unit detects the reflected light amount of the second reflected light and the reflected light amount of the third reflected light after the reflected light amount of the first reflected light has been detected.

3. The apparatus according to claim 2, wherein said detection unit detects the reflected light amount of the second reflected light and the reflected light amount of the third reflected light in the second rotation, which is next to the first rotation, in which the reflected light amount of the first reflected light has been detected.

4. The apparatus according to claim 1, wherein said detection unit detects the reflected light amount of the first reflected light after the reflected light amount of the second reflected light and the reflected light amount of the third reflected light have been detected.

5. The apparatus according to claim 4, wherein said detection unit detects the reflected light amount of the first reflected light in the first rotation, which is next to the second rotation, in which the reflected light amount of the second reflected light and the reflected light amount of the third reflected light have been detected.

6. The apparatus according to claim 1, wherein a positional range along a circumference of the image carrier where the first reflected light is detected includes at least a positional range along the circumference of the image carrier where the second reflected light is detected.

7. The apparatus according to claim 1, wherein said control unit adjusts a density of the toner image to be formed by said image forming unit by adjusting the image forming condition of said image forming unit.

8. The apparatus according to claim 1, wherein said background reflected light amount estimation unit calculates the change ratio by calculating the change ratio of the reflected light amount between the first rotation and the second rotation of the image carrier from the reflected light amounts of the first reflected light detected at the second part of each one of the plurality of positions in the first rotation of the image carrier and the reflected light amounts of the third reflected light detected in the second rotation of the image carrier at the second part of each one of the plurality of positions where the toner image is not formed, and modifies, by the change ratio, a variation value of the reflected light amount of the first reflected light at the background of the first part of each one of the plurality of positions in the first rotation of the image carrier to calculate the reflected light amount at the background of the first part of each one of the plurality of positions in the second rotation of the image carrier.

9. The apparatus according to claim 8, wherein said background reflected light amount estimation unit is further configured to:

derive a first equation that expresses a relationship between a position and a reflected light amount from the reflected light amounts of the first reflected light detected at each one of the plurality of positions in the first rotation of the image carrier;

calculate, as a variation value, a difference between reflected light amounts calculated from the first equation at the background of the positions and the reflected light amounts of the first reflected light detected at each one of the plurality of positions in the first rotation of the image carrier;

derive a second equation that expresses a relationship between a position and a reflected light amount from the reflected light amounts of the third reflected light detected at the background of the second part of each one of the plurality of positions in the second rotation of the image carrier where the toner image is not formed;

calculate a change ratio of the reflected light amount between the first rotation and the second rotation of the image carrier from the reflected light amount calculated from the first equation and the reflected light amount calculated from the second equation for the background of the first part of each one of the plurality of positions where the toner image is formed in the second rotation of the image carrier; and correct the variation value at the background of each one of the plurality of positions in the first rotation of the image carrier by the corresponding change ratio, thereby calculating the variation value at the background of each one of the plurality of positions in the second rotation of the image carrier, and said background reflected light amount estimation unit is further configured to calculate the reflected light amounts from the second equation for the background of the first part of each one of the plurality of positions where the toner image is formed in the second rotation of the image carrier, and correct each one of the reflected light amounts by a corresponding modified variation value, thereby calculating the reflected light amount at the background of the first part of each one of the plurality of positions where the toner image is formed in the second rotation of the image carrier.

10. The apparatus according to claim 9, wherein said background reflected light amount estimation unit is further configured to calculate an average value of the reflected light amounts of the first reflected light detected at the background of the positions in the first rotation of the image carrier and derive the first equation from a plurality of average values.

11. The apparatus according to claim 10, wherein said background reflected light amount estimation unit is further configured to calculate an average value of the reflected light amounts of the third reflected light detected in the second rotation of the image carrier and derive the second equation from a plurality of average values.

12. The apparatus according to claim 9, wherein said background reflected light amount estimation unit is further configured to calculate an average value of the reflected light amounts of the third reflected light detected in the second rotation of the image carrier at the background of the second part of each one of the plurality of positions where the toner image is not formed and derive the second equation from a plurality of average values.

13. The apparatus according to claim 1, wherein said background reflected light amount estimation unit is further configured to calculate the change ratio of the reflected light amount between the first rotation and the second rotation of the image carrier at the background of the positions of the image carrier from the reflected light amounts of the first reflected light detected at the background of the positions in the first rotation of the image carrier and the reflected light amounts of the third reflected light detected in the second rotation of the image carrier at the background of the second part of each one of the plurality of positions where the toner image is not formed, and correct, by the change ratio, the reflected light amount of the first reflected light detected at the background of each one of the plurality of positions in the first rotation of the image carrier, thereby estimating the reflected light amount at the background of the first part of each one of the plurality of positions where the toner image is formed in the second rotation of the image carrier.

14. The apparatus according to claim 1, wherein said correction unit is further configured to calculate an average value of the reflected light amounts of the second reflected light from the toner image detected in the second rotation of the image carrier, and correct the average value by the reflected light amount estimated by said background reflected light amount estimation unit.

15. The apparatus according to claim 1, further comprising:

a profile derivation unit configured to calculate a first profile from the reflected light amounts detected at the background of the positions in the first rotation of the image carrier and calculate a second profile from the reflected light amounts detected at the toner image formed on the first part of each one of the plurality of positions and the background of the second part of each one of the plurality of positions in the second rotation of the image carrier; and a position data modification unit configured to specify a position where the reflected light amount is detected in the second rotation of the image carrier, which corresponds to a position where the reflected light amount is detected in the first rotation of the image carrier by comparing the first profile with the second profile, and correct data of the position where the reflected light amount is detected in the second rotation of the image carrier.

16. An image forming apparatus comprising:

a detection unit configured to detect reflected light from a background at each one of a plurality of positions of a peripheral surface of a rotation member in an hth rotation of the rotation member as the rotation member rotates, and detect, in an ith rotation of the rotation member, reflected light from a toner image formed on the background of a first part of each one of the plurality of positions of the rotation member and reflected light from the background of a second part of each one of the plurality of positions around the toner image where no toner image is formed as the rotation member rotates (h and i are different natural numbers);

a background reflected light amount estimation unit configured to calculate a change ratio between reflected light amounts detected at the background of each one of the plurality of positions in the hth rotation of the rotation member and reflected light amounts detected in the ith rotation of the rotation member at the background of the second part of each one of the plurality of positions where no toner image is formed, and to estimate a reflected light amount at the background of the first part of each one of the plurality of positions where the toner image is formed in the ith rotation, based on the change ratio;

a correction unit configured to correct the reflected light amount from the toner image detected in the ith rotation of the rotation member by a corresponding reflected light amount estimated by said background reflected light amount estimation unit; and a control unit configured to adjust an image forming condition concerning a density based on the reflected light amount corrected by said correction unit.

17. A method of image forming, comprising the steps of:

detecting reflected light from a background at each one of a plurality of positions of a peripheral surface of a rotation member in an hth rotation of the rotation member as the rotation member rotates, and detecting, in an ith rotation of the rotation member, reflected light from a toner image formed on the background of a first part of each one of the plurality of positions of the rotation member and reflected light from the background of a second part of each one of the plurality of positions around the toner image where no toner image is formed as the rotation member rotates (h and i are different natural numbers);

calculating a change ratio between reflected light amounts detected at the background of each one of the plurality of positions in the hth rotation of the rotation member and reflected light amounts detected in the ith rotation of the rotation member at the background of the second part of each one of the plurality of positions where no toner image is formed, and estimating a reflected light amount at the background of the first part of each one of the plurality of positions where the toner image is formed in the ith rotation of the rotation member, based on the change ratio;

correcting the reflected light amount from the toner image detected in the ith rotation of the rotation member by a corresponding reflected light amount estimated in the step of estimating the reflected light amount; and adjusting an image forming condition concerning a density based on the reflected light amount corrected in the step of correcting the reflected light amount.

18. An image forming apparatus comprising:

an image forming unit configured to form a toner image on an image carrier;

a detection unit configured to detect, as the image carrier rotates, first reflected light from a background of each one of a plurality of positions of the image carrier in a state in which the toner image is not formed on each one of the plurality of positions of the image carrier in a first rotation, second reflected light from the toner image formed on a first part of each one of the plurality of positions of the image carrier in a state in which the toner image is formed on the first part of each one of the plurality of positions of the image carrier in a second rotation, and third reflected light from the background of a second part of each one of the plurality of positions around the toner image where no toner image is formed in the second rotation;

a background reflected light amount estimation unit configured to estimate a reflected light amount at the background of the first part of each one of the plurality of positions where the toner image is formed in the second rotation, based on reflected light amounts of the first reflected light at the background of the first part of each one of the plurality of positions in the first rotation and reflected light amounts of the third reflected light at the background of the second part of each one of the plurality of positions in the second rotation, which are detected by said detection unit;

a correction unit configured to correct a reflected light amount of the second reflected light by a corresponding reflected light amount estimated by said background reflected light amount estimation unit; and a control unit configured to adjust an image forming condition of said image forming unit based on the reflected light amount corrected by said correction unit, wherein said detection unit detects the reflected light amount of the first reflected light after the reflected light amount of the second reflected light and the reflected light amount of the third reflected light have been detected.

19. An image forming apparatus comprising:

a detection unit configured to detect reflected light from a background at each one of a plurality of positions of a peripheral surface of a rotation member in an hth rotation of the rotation member as the rotation member rotates, and detect, in an ith rotation of the rotation member, reflected light from a toner image formed on the background of a first part of each one of the plurality of positions of the rotation member and reflected light from the background of a second part of each one of the plurality of positions around the toner image where no toner image is formed as the rotation member rotates (h and i are different natural numbers);

a background reflected light amount estimation unit configured to estimate a reflected light amount at the background of the first part of each one of the plurality of positions where the toner image is formed in the ith rotation of the rotation member from reflected light amounts detected at the background of each one of the plurality of positions in the hth rotation of the rotation member and reflected light amounts detected in the ith rotation of the rotation member at the background of the second part of each one of the plurality of positions where no toner image is formed;

a correction unit configured to correct the reflected light amount from the toner image detected in the ith rotation of the rotation member by a corresponding reflected light amount estimated by said background reflected light amount estimation unit; and a control unit configured to adjust an image forming condition concerning a density based on the reflected light amount corrected by said correction unit, wherein said detection unit detects the reflected light from the background at each one of a plurality of positions of the peripheral surface of the rotation member in the hth rotation of the rotation member as the rotation member rotates, after detecting, in the ith rotation of the rotation member, the reflected light from the toner image formed on the background of the first part of each one of the plurality of positions of the rotation member and the reflected light from the background of the second part of each one of the plurality of positions around the toner image where no toner image is formed as the rotation member rotates.

* * * * *